US008038499B2

(12) United States Patent
Kim et al.

(10) Patent No.: US 8,038,499 B2
(45) Date of Patent: Oct. 18, 2011

(54) FLAT DISPLAY PANEL AND METHOD FOR MANUFACTURING A FLAT PANEL DISPLAY

(75) Inventors: Bong Hyang Kim, Gyeonggi-do (KR); Soon Kook Hong, Gyeonggi-do (KR); Kang Ug Lee, Gyeonggi-do (KR); Dug Hwan Kim, Gyeonggi-do (KR); Seung Mok Oh, Seoul (KR); Sang Soo Lee, Gyeonggi-do (KR); Seung Yong Shin, Seoul (KR); Seok Gu Kim, Gyeonggi-do (KR); Dae Chul Kang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 12/606,272

(22) Filed: Oct. 27, 2009

(65) Prior Publication Data

US 2010/0048086 A1 Feb. 25, 2010

Related U.S. Application Data

(62) Division of application No. 11/591,681, filed on Nov. 2, 2006, now abandoned.

(30) Foreign Application Priority Data

Nov. 3, 2005 (KR) ..... 2005-0104954

(51) Int. Cl.
*H01J 9/00* (2006.01)

(52) U.S. Cl. ..... 445/49; 445/50
(58) Field of Classification Search ..... 445/23–25, 445/49–51
See application file for complete search history.

(56) References Cited

U.S. PATENT DOCUMENTS

| | | | | |
|---|---|---|---|---|
| 6,242,859 | B1 | 6/2001 | Betsui et al. | 313/584 |
| 2002/0008472 | A1 | 1/2002 | Ha | 313/582 |
| 2002/0063525 | A1 | 5/2002 | Choi et al. | 313/582 |

FOREIGN PATENT DOCUMENTS

JP 2003-162962 6/2003

OTHER PUBLICATIONS

Office Action dated Feb. 27, 2009 from parent U.S. Appl. No. 11/591,681.
Office Action dated Jul. 17, 2009 from parent U.S. Appl. No. 11/591,681.

*Primary Examiner* — Joseph L Williams
(74) *Attorney, Agent, or Firm* — KED & Associates, LLP

(57) ABSTRACT

In a flat display panel, a surface of at least one of a sustain electrode and an address electrode may be formed to have a curved surface. The surface of the electrode may be formed as a continuous curved surface. The sustain electrode and the address electrode may be elongated in a lengthwise direction thereof. These lengthwise directions may be perpendicular to each other. The electrode may be formed by transferring an electrode material onto the substrate using an electrode frame defined with electrode forming grooves each having a same sectional shape as the electrode. Therefore, the surface of the electrode may be formed as the curved surface.

7 Claims, 4 Drawing Sheets

FLAT DISPLAY PANEL AND METHOD FOR MANUFACTURING A FLAT PANEL DISPLAY

This application is a Divisional Application of U.S. application Ser. No. 11/591,681, filed Nov. 2, 2006, now abandoned which claims priority from Korean Patent Application No. 2005-0104954 filed Nov. 3, 2005, the subject matters of which are incorporated herein by reference.

BACKGROUND

1. Field

Embodiments of the present invention may relate to a flat display panel. More particularly, embodiments of the present invention may relate to a flat display panel and method in which a first flat substrate and a second flat substrate are coupled with each other to display an image.

2. Background

Flat display panels may include a liquid crystal display panel and a plasma display panel. The plasma display panel is a kind of an image display device in which two glass substrates are airtightly coupled with each other to display an image using an electric discharge phenomenon of a gas in a space defined between the two glass substrates.

BRIEF DESCRIPTION OF THE DRAWINGS

Embodiments of the present invention may become more apparent after a reading of the following detailed description when taken in conjunction with the drawings in which like reference numerals refer to like elements and wherein.

DETAILED DESCRIPTION

Figure 1:
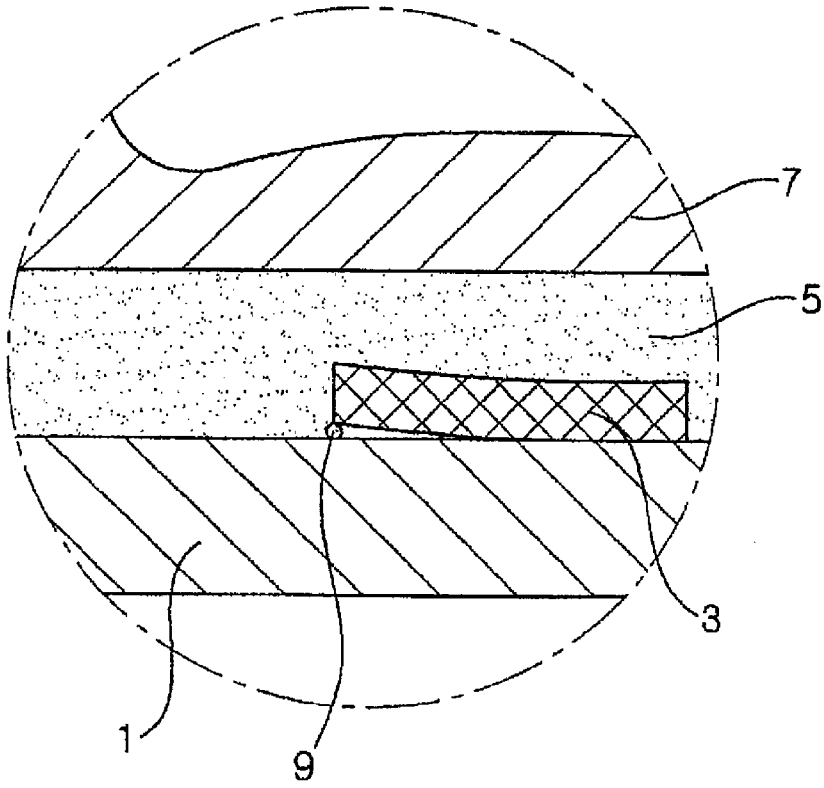
Fig. 1 PRIOR ART
FIG. 1 is a partial cross-sectional view illustrating a main part of a plasma display panel according to an example arrangement.

FIG. 1 illustrates a main part of a plasma display panel according to an example arrangement. Other arrangements may also be provided. The drawing exemplifies the rear substrate of the plasma display panel. As shown, an electrode 3 is formed on a substrate 1 to have a predetermined thickness and width. The electrode 3 may induce an electric discharge in each cell.

A white back 5 may be applied on the substrate 1 in such a way to cover the electrode 3. The white back 5 may forwardly reflect visible light that is generated from a fluorescent layer 7 formed in each cell and is directed backward.

To form the electrode 3 on the substrate 1, an electrode paste may be applied on a glass and dried to remove a solvent, etc. After the drying, a selective exposure may be implemented on the electrode paste. Light may be selectively irradiated onto the electrode paste using a mask, etc.

A development process may then be conducted. Portions of the electrode paste that are changed or not changed in their properties due to the exposure may be selectively removed. After the selective removal of the electrode paste, a shape of the electrode 3 may be defined. When the electrode 3 is formed through the exposure and development processes, the electrode 3 may have a substantially quadrangular sectional shape.

With the shape of the electrode 3 defined, a baking process may be conducted to complete the electrode 3. After the electrode 3 is completed, the white back 5 may be applied. Partitioning walls may then be formed on the white back 5 and the fluorescent layer 7 may be applied.

The plasma display panel constructed and manufactured as discussed above may have problems. For example, in order to form the electrode 3, five processes may be implemented such as paste application, drying, exposure, development and baking processes. Therefore, productivity may deteriorate as the procedure for forming the electrode 3 requires a lengthy period.

Further, since the electrode 3 is formed in a manner such that both side surfaces of the electrode 3 are substantially perpendicular to an upper surface of the electrode 3, a curl may be produced in an end of the electrode 3 when applying the white back 5. A bubble 9 may thereby be created in the white back 5 as shown in FIG. 1. When a volume of the bubble 9 is abruptly changed due to a high temperature during operation of the plasma display panel, cracks may develop in the white back 5, the partitioning walls, etc.

Figure 2:
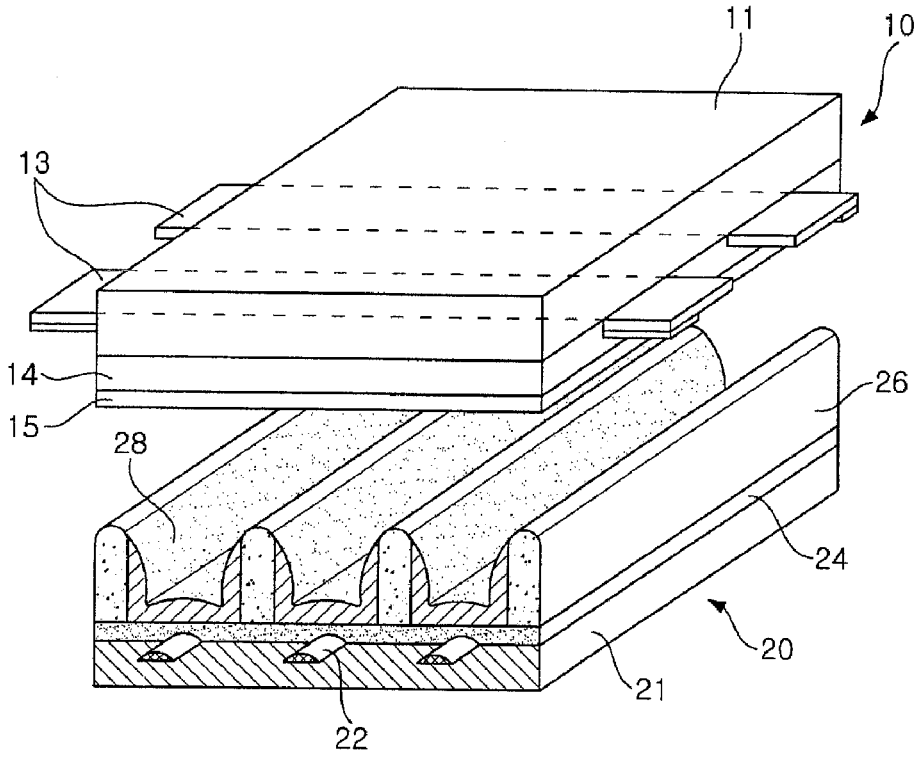
FIG. 2 is an exploded perspective view illustrating a plasma display panel in accordance with an example embodiment of the present invention.

A flat display panel and a method for manufacturing a flat display panel in accordance with example embodiments of the present invention will be described with reference to FIGS. 2-5. FIG. 2 illustrates a three electrode face-discharge type plasma display panel according to an example embodiment of the present invention. Other embodiments and configurations are also within the scope of the embodiments of the present invention.

A front substrate 10 and a rear substrate 20 may be coupled with each other under a vacuum condition to constitute a plasma display panel. In the front substrate 10, a plurality of sustain electrodes 13 for sustain discharge, a dielectric layer 14 for limiting a discharge current and a protective layer 15 for protecting the dielectric layer 14 may be sequentially formed on a substrate 11.

A substrate 21 for forming a skeleton of the rear substrate 20 may have a shape of a plate having a predetermined area. The substrate 21 may be formed of glass, for example. A plurality of address electrodes 22 may be formed on the substrate 21 and may be elongated in one direction. The address electrodes 22 may induce address discharge between the sustain electrodes 13 (of the front substrate 10) and the address electrodes 22 (of the rear substrate 20).

Figure 3:
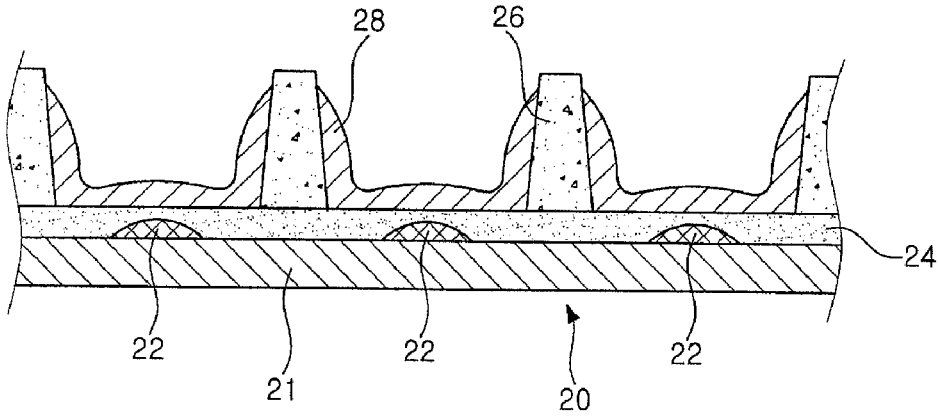
FIG. 3 is a partial cross-sectional view illustrating a main part of the plasma display panel in accordance with an example embodiment of the present invention.

As can be seen from FIG. 3, the address electrodes 22 may be formed to have a cross-sectional shape of an arch that has a predetermined radius of curvature. More specifically, the surface of each address electrode 22 may be formed as a continuous curved surface that has a predetermined curvature. The curved surface may be considered a convex surface (or convex shape) that faces a discharge space and the front substrate 10. While the surface of the address electrode 22 may not necessarily have a predetermined curvature, it may be convenient for the surface of the address electrode 22 to have a predetermined curvature when forming the address electrodes 22. The other surface of the address electrode 22 may be a relatively flat surface formed on the substrate 21.

A white back 24 may be applied on the rear substrate 20 to cover the address electrodes 22. The white back 24 may specifically cover the curved surface of the address electrode 22. The white back 24 may forwardly reflect visible light generated from a fluorescent layer 28.

Partitioning walls 26 may be formed on the white back 24 at regular intervals, for example. The partitioning walls 26 may be formed on the white back 24 and may be positioned at an area between two adjoining address electrodes 22. The partitioning walls 26 may define discharge spaces in cooperation with an upper surface of the white back 24. The partitioning walls 26 may be formed on the substrate 21 before applying the white back 24. After the partitioning walls 26 are formed, the white back 24 may be applied on the substrate 21 in the spaces formed (or compartmented) by the partitioning walls 26.

The fluorescent layer 28 may be applied on the side surface of the portioning walls 26 and the upper surface of the white back 24. The fluorescent layer 28 may include R, G and B fluorescent substances that respectively represent red, green and blue and may be alternately applied in spaces formed (or compartmented) by the partitioning walls 26.

In the plasma display panel constructed as discussed above, if a discharge start voltage of 150V~300V is supplied to the sustain electrode 13 and the address electrode 22 that reside in a discharge cell, wall electric charges may be produced on inner surfaces of the corresponding discharge space. Thereafter, as an address discharge voltage is supplied to the sustain electrode 13 and the address electrode 22, an address discharge occurs between the sustain electrode 13 and the address electrode 22.

By the address discharge, as an electric field is created in the cell, electrons in a discharge gas may be accelerated and come into collision with neutral particles of the gas to be ionized into electrons and ions. Due to continuous collisions between the ionized electrons and neutral particles, the neutral particles may be ionized into electrons and ions at a gradually increasing speed. As the discharge gas is changed to a plasma state, ultraviolet rays may be generated under a vacuum condition and may excite the fluorescent layer 28. As visible light is generated, the cell may emit light and the display image may be recognized by a person. If a sustain discharge voltage of greater than 150V is supplied to the corresponding sustain electrode 13, a sustain discharge may occur in the corresponding discharge cell, and the light emission of the cell may be held for a predetermined time.

A method for manufacturing a plasma display panel in accordance with an example embodiment of the present invention will now be described with reference to FIG. 4. For the sake of convenience in explanation, descriptions will be presented based on the rear substrate.

Figure 4A:
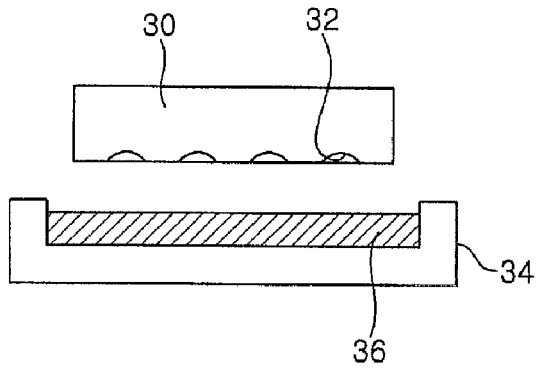
FIGS. 4*a* through 4*f* are cross-sectional views sequentially illustrating a method for manufacturing a plasma display panel in accordance with an example embodiment of the present invention.

FIG. 4*a* illustrates a cross-section of an electrode frame 30. Electrode forming grooves 32 each having a same sectional shape as the electrode (i.e., the address electrode 22) may be defined on a lower surface of the electrode frame 30. The electrode forming grooves 32 are illustrated as being cut in a direction perpendicular to a lengthwise direction of the address electrodes 22. As can be seen from the cross-sectional view, the electrode forming grooves 32 may be formed to have curved bottom surfaces that match the address electrodes 22. The curved bottom surfaces may be convex shaped. The electrode forming grooves 32 may be parallel to one another and may be elongated in one direction.

The electrode frame 30 may have a shape corresponding to a shape of the substrate 21 to be formed with the address electrodes 22. For example, if the substrate 21 has the shape of a square plate, then at least the surface of the electrode frame 30 defined with the electrode forming grooves 32 may be formed to have a square shape. Further, the electrode frame 30 may be designed such that the address electrodes 22 can be formed over an entire area (or a substantially entire area) of the single substrate 21. The substrate 21 may also be divided into several regions and the size of the electrode frame 30 can be appropriately designed so that the electrodes 22 can be sequentially formed in the respective regions.

The electrode frame 30 may be formed of a material having predetermined elasticity so that electrode material 36 can be properly transferred to the rear substrate 20. For example, the electrode frame 30 may be made of soft rubber or silicon. The electrode frame 30 may use a material having a predetermined elasticity because the electrode material 36 may be appropriately transferred to the rear substrate 20 by applying pressure to the electrode frame 30. As long as the electrode material 36 can be appropriately transferred to the rear substrate 20, the electrode frame 30 may be made of a metal or a rock.

An electrode material supply source 34 may supply the electrode material 36 to the electrode forming grooves 32 of the electrode frame 30. In other words, a predetermined amount of the electrode material 36 may be accommodated in the electrode material supply source 34.

Figure 4B:
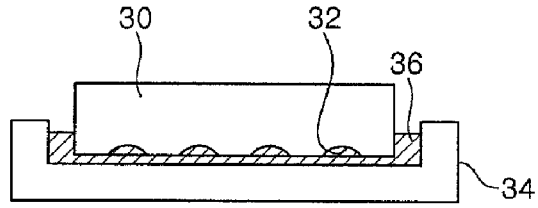
Figure 4C:
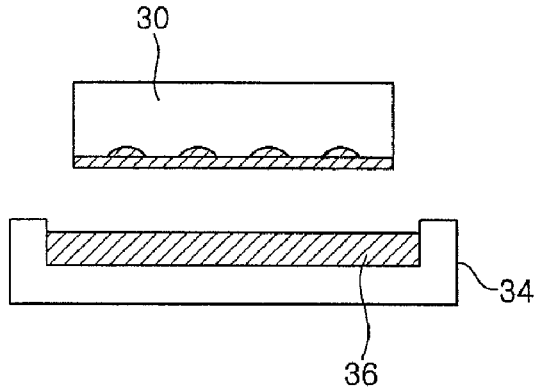

As the electrode frame 30 is dipped into the electrode material 36 in the electrode material supply source 34 as shown in FIG. 4*b*, the electrode material 36 may adhere to the lower surface of the electrode frame 30 and may fill the electrode forming grooves 32. FIG. 4*c* illustrates a state in which the electrode material 36 adheres to the lower surface of the electrode frame 30 and may fill the electrode forming grooves 32.

Figure 4D:
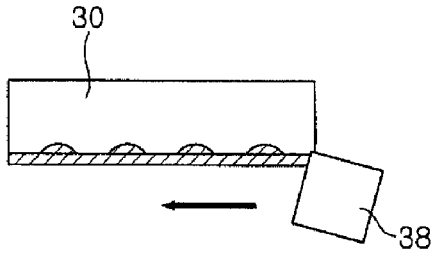

The electrode material 36 that adheres to the lower surface of the electrode frame 30 may be removed. That is, a removal element 38 may be brought into close contact with the lower surface of the electrode frame 30 and may then be moved along the lower surface of the electrode frame 30 as shown in FIG. 4*d*. The removal element 38 may be made of a material having elasticity. The electrode material 36 may be only left in the electrode forming grooves 32 of the electrode frame 30.

Figure 4E:
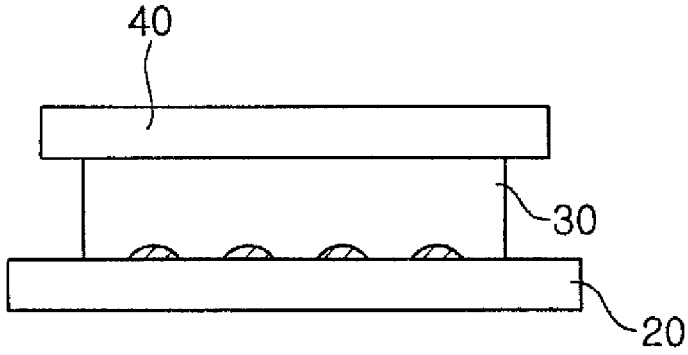

FIG. 4*e* illustrates a process in which the electrode frame 30 is placed on the substrate 21 and pressure is applied to the electrode frame 30 to transfer the electrode material 36 to the substrate 21. In order to uniformly apply the pressure to the electrode frame 30, a pressure plate 40 may be employed to apply the pressure to the electrode frame 30. The pressure plate 40 may have an area that is the same as or greater than an area of the substrate 21. By applying pressure to the electrode frame 30 against the substrate 21 using the pressure plate 40, the electrode material 36 that is filled in the electrode forming grooves 32 may be transferred to the substrate 21.

Figure 4F:
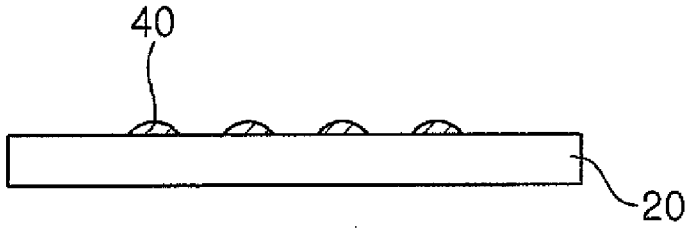

FIG. 4*f* illustrates a state in which the electrode material 36 filled in the electrode forming grooves 32 is transferred to the substrate 21. With the electrode material 36 transferred to the rear substrate 20, by implementing drying and baking processes and baking the electrode material 36, the address electrodes 22 may be completed. Since the drying and baking processes are known in the art, a detailed description thereof will be omitted for ease of discussion.

Working effects of the flat display panel and a method for manufacturing a flat display panel will now be described.

All the address electrodes 22 (or portions thereof) may be formed at one time by transferring the electrode material 36 to the substrate 21 using the electrode frame 30 defined with the electrode forming grooves 32 each having a same cross-sectional shape as the address electrodes 22. After the electrode material 36 is transferred to the substrate 21 using the electrode frame 30, the electrode material 36 may be baked by implementing the drying and baking processes, whereby the address electrodes 22 are completed.

Figure 5:
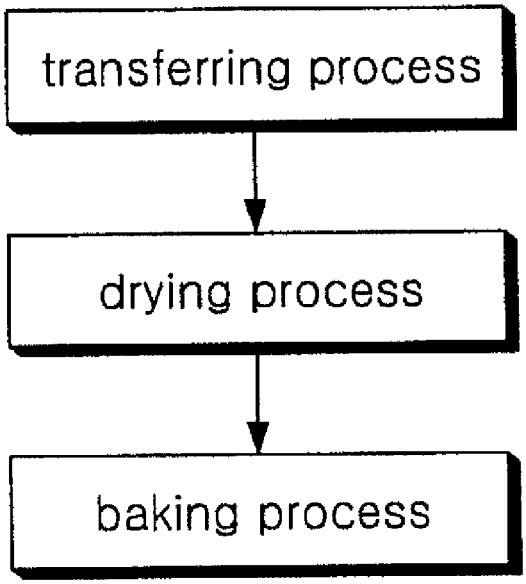
FIG. 5 is a block diagram of a method for manufacturing a plasma display panel in accordance with an example embodiment of the present invention.

FIG. 5 is a block diagram that summarizes a method for manufacturing a plasma display panel in accordance with an example embodiment of the present invention. Other embodiments, configurations and operations are also within the scope of embodiments of the present invention.

When viewed in its cross-sectional shape, the address electrode 22 may have a shape of an arch. That is, the surface of the address electrode 22 may be formed as a curved surface and/or as a continuous curved surface. Since the surface of the address electrode 22 may be a curved surface, when implementing a subsequent process (i.e., when applying the white back 24 in the case of the rear substrate 20), a defect may be prevented. In the case of the front substrate 10, by forming the surface of the sustain electrode 10 as a curved surface, a defect may be prevented when applying the dielectric layer 14.

The process for forming the address electrodes 22 on the substrate 21 using the electrode frame 30 may be implemented as described above. Once the address electrodes 22 are formed, the white back 24 may be applied on the address electrodes 22 and the substrate 21.

In the course of applying the white back 24, since the surfaces of the address electrodes 22 are formed as curved surfaces, a curl may not be produced. Additionally, even in a portion that is adjacent to a periphery of the address electrode 22, the white back 24 may be reliably applied. Thereafter, processes for forming the partitioning walls 26 and the fluorescent layer 28 may be implemented whereby manufacture of the rear substrate 20 may be completed.

Embodiments of the present invention may relate to a flat display panel. While a procedure for manufacturing a plasma display panel has been explained with respect to the illustrated embodiments, embodiments of the present invention may also be applied to manufacture of a liquid crystal display panel in a similar manner.

Further, while it has been described that surfaces of the address electrodes 22 are formed as curved surfaces, surfaces of the sustain electrodes 13 may also be formed as curved surfaces. Depending upon a design condition, only the sustain electrodes 13 may be formed as curved surfaces, and the address electrodes 32 may be formed as non-curved surfaces.

Embodiments of the present invention may form an electrode through a simple procedure.

Embodiments of the present invention may apply a substance for covering the electrode formed on a substrate of a flat display panel while not creating a bubble.

Embodiments of the present invention may provide a plasma display panel that includes a front substrate having a sustain electrode formed on a surface of a substrate to be elongated in one direction and a dielectric layer formed on the substrate to cover the sustain electrode. The plasma display panel may also include a rear substrate having an address electrode formed on a surface of a substrate to face the sustain electrode of the front substrate and being elongated in a direction perpendicular to the one direction. A white back may be applied on the substrate to cover the address electrode. A fluorescent layer may be applied in a discharge space compartmented by partitioning walls projectedly formed on the substrate. The front substrate may be coupled to the partitioning walls of the rear substrate to define the discharge space between the partitioning walls. At least one of the sustain electrode and the address electrode has a surface that is formed as a curved surface.

The curved surface that forms the surface of the electrode may be an entirely continuous curved surface. The electrode may be formed to have an arch-shaped cross-section that possesses a predetermined radius of curvature.

The partitioning walls may be formed to project on the white back applied to the substrate of the rear substrate. The partitioning walls may project on the rear substrate and the white back may be applied on the substrate to cover the address electrode in the discharge space compartmented by the partitioning walls.

Embodiments of the present invention may provide a method for manufacturing a plasma display panel that includes transferring an electrode material onto a substrate using an electrode frame defined with electrode forming grooves each having a same sectional shape as an electrode and being elongated in one direction and possessing a bottom surface formed as a rounded surface and which has a shape corresponding to at least a partial region of the substrate. The method may also include drying the electrode material transferred onto the substrate in the transferring, and baking the electrode material dried in the drying.

At least a surface of the electrode frame that is defined with the electrode forming grooves has an area corresponding to that of the substrate so that electrodes can be simultaneously formed on the entire substrate.

The transferring may include filling the electrode material of an electrode material supply source in the electrode forming grooves of the electrode frame. The method may also include recovering the electrode material that is not filled in the electrode forming grooves and transferring the electrode material filled in the electrode forming grooves of the electrode frame onto the substrate.

The electrode frame may be made of a material having predetermined elasticity. The electrode frame may be made of one selected from the group of rubber or silicon.

Pressure may be applied to an entire electrode frame by means of a pressure plate to transfer the electrode material filled in the electrode forming grooves of the electrode frame onto the substrate.

In the recovering, the electrode material that is not filled in the electrode forming grooves may be recovered by moving a removal element having elasticity on the surface of the electrode frame.

Embodiments of the present invention may provide a method for manufacturing a flat display panel that includes transferring an electrode material onto a substrate using an electrode frame that is defined with electrode forming grooves each having a same sectional shape as an electrode, and being elongated in one direction and possessing a bottom surface formed as a rounded surface and that has a shape corresponding to a shape of the substrate. The method may also include drying the electrode material transferred onto the substrate in the transferring, and baking the electrode material dried in the drying.

Embodiments of the present invention may provide a flat display panel that includes a substrate having an insulating substrate on at least one surface thereof, defined on a surface of the substrate with electrode lines elongated in one direction, and applied on the substrate with a dielectric layer to cover the electrode lines. Each of the electrode lines may have a surface that is formed as a curved surface.

The curved surface that forms the surface of each electrode line may include an entirely continuous curved surface.

Each electrode line may be formed to have an arch-shaped cross-section that possesses a predetermined radius of curvature.

Embodiments of the present invention may provide a method for manufacturing a flat display panel that includes transferring an electrode material onto a substrate using an electrode line frame defined with electrode line forming grooves each having a same sectional shape as an electrode line, being elongated in one direction and possessing a bottom surface formed as a rounded surface and that has a shape corresponding to at least a partial region of the substrate. The method may also include drying the electrode material transferred onto the substrate in the transferring, and baking the electrode material dried in the drying.

Embodiments of the present invention may provide a plasma display panel that includes a first substrate having a sustain electrode formed on a surface of the first electrode to be elongated in one direction, and a dielectric layer formed on the surface of the first substrate to cover the sustain electrode. A second substrate may have an address electrode formed on a surface of the second substrate to be elongated in a direction perpendicular to the one direction. A white back may be applied on the second substrate to cover the address electrode. Partitioning walls may be projectedly formed on the second substrate to allow the address electrode to be positioned therebetween and to cooperate with the first substrate to define a discharge space. At least one of the sustain electrode and the address electrode may have a surface that is formed as a curved surface.

As is apparent from the above descriptions, a flat display panel and a method for manufacturing a flat display panel may provide advantages. For example, after an electrode material is filled in electrode forming grooves that are defined on a surface of an electrode frame and each of which has a same sectional shape as an electrode, the electrode material may be transferred to a substrate and may then be baked to form the electrode. Accordingly, a procedure for forming the electrode on the substrate may be greatly simplified.

The electrode material may be transferred only to necessary portions of the substrate. Since there is no electrode material that is applied on the substrate and then removed, a required amount of electrode material can be minimized. Hence, manufacturing costs of the flat display panel can be significantly reduced.

Further, the surface of each electrode may be formed as a curved surface. Therefore, in the course of applying a substance on the substrate to cover the electrode, a bubble may not be created around the electrode, whereby quality of the flat display panel may be remarkably improved.

Any reference in this specification to "one embodiment," "an embodiment," "example embodiment," etc., means that a particular feature, structure, or characteristic described in connection with the embodiment is included in at least one embodiment of the present invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of manufacturing a plasma display panel, comprising:

transferring an electrode material onto a substrate using an electrode frame having electrode forming grooves formed thereon, each groove having a shape corresponding to an electrode, the electrode forming grooves extending in one direction and each groove including a surface formed as a rounded surface;

drying the electrode material transferred onto the substrate; and baking the electrode material dried in the drying.

2. The method as set forth in claim 1, wherein at least a surface of the electrode frame has an area corresponding to an area of the substrate so that electrodes can be formed on the entire substrate.

3. The method as set forth in claim 1, wherein the transferring comprises:

providing the electrode material of an electrode material supply source in the electrode forming grooves;

removing the electrode material that is not provided in the electrode forming grooves; and transferring the electrode material provided in the electrode forming grooves onto the substrate.

4. The method as set forth in claim 3, wherein the transferring includes applying pressure to the electrode frame so as to transfer the electrode material provided in the electrode forming grooves onto the substrate.

5. The method as set forth in claim 3, wherein the removing includes moving a removal element across the surface of the electrode frame.

6. The method as set forth in claim 1, wherein the electrode frame comprises a material having a predetermined elasticity.

7. The method as set forth in claim 1, wherein the electrode frame is made of one of rubber or silicon.

* * * * *